United States Patent [19]

Hamilton et al.

[11] 4,418,913

[45] Dec. 6, 1983

[54] BINGO CARDS RACK AND CARD CLIP

[75] Inventors: Norman L. Hamilton, P.O. Box 391, Oilfield Rd., Cold Spring, Tex. 77331; Charles B. Carpenter, San Leon, Tex.

[73] Assignee: Norman L. Hamilton, Cold Spring, Tex.

[21] Appl. No.: 371,787

[22] Filed: Apr. 26, 1982

[51] Int. Cl.[3] ..... A63F 3/06

[52] U.S. Cl. ..... 273/150; 40/395; 40/401

[58] Field of Search ..... 273/148 A, 150, 269, 273/270; 40/391, 395, 401, 530, 534, 533

[56] References Cited

U.S. PATENT DOCUMENTS

| | | | |
|---|---|---|---|
| 396,929 | 1/1889 | Hammann | 40/534 |
| 1,649,244 | 11/1927 | McDonald | 40/395 X |
| 1,811,245 | 6/1931 | Powell | 40/395 |
| 2,147,773 | 2/1939 | Larson | 40/401 |
| 2,779,114 | 1/1957 | Orthwine | 273/150 UX |
| 3,524,645 | 8/1970 | Breslow | 273/150 X |
| 4,241,921 | 12/1980 | Miller | 273/148 A |
| 4,291,882 | 9/1981 | Monte | 273/14 8 A |

*Primary Examiner*—Harland S. Skogquist
*Attorney, Agent, or Firm*—Roy Hammond Smith, Jr.

[57] ABSTRACT

The rack permits a single player to play a large number of bingo cards in every game, and without preempting more than his fair share of table space. The rack has a multiplicity of long horizontal rods extending from the player's left to right and supported by a pair of end frames, for instance 4 or 5 such rods, parallel to each other. The rod nearest the player is closest to the table, and is spaced above it a little more than the thickness of two bingo cards. This same spacing is used between rods, i.e., a staircase spacing with the same spacing of the second rod both above and behind the first rod, etc. The bingo cards are mounted in back-to-back pairs in special clips mounted on the rods and pivotal between a vertical position and a horizontal position, reading one card of a pair in each position. Each clip has portions defining a pocket which has an open top and one open side, so that a marginal portion of the pair of bingo cards is received in the pocket. The clip includes a pair of arcuate spring fingers which bow towards one another and are forced apart as the cards are inserted; the reaction of these spring fingers releasably retains the cards. Each clip preferably has an elongated narrow slit through its end member, midway between the spring fingers. Such slits may be aligned from one clip to the next so that a thin plate or strip joins a pair of opposing clips and defines a front pocket and a back pocket. The clips thus joined stay together when no cards are in place, and the connecting plate may be extended to join a second pair or clips so that four cards or six cards, etc., may be rotated as one unit.

13 Claims, 5 Drawing Figures

FIG. 3·a
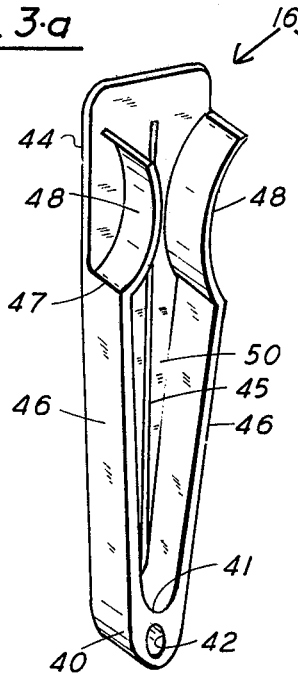
FIG. 3·b
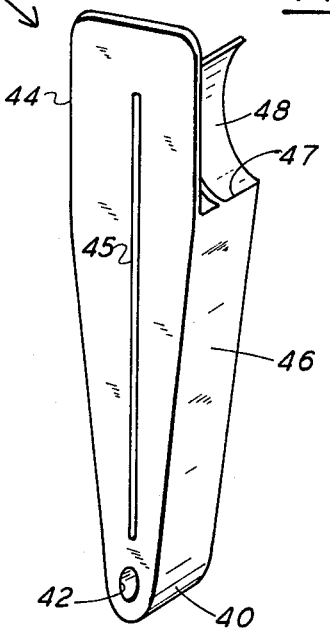
FIG. 4
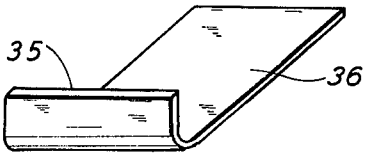

BINGO CARDS RACK AND CARD CLIP

BACKGROUND OF THE INVENTION

The present invention lies in the general field of table top games, "bingo" in particular. Even more particularly, it deals with a rack or holder which permits one player to use a multiplicity of cards in a single game, in an efficient manner.

At the same time, the invention deals with clips and racks that may be used to efficiently mount and display cards and other types of documents used in many other fields, e.g., photographs, medical charts and the like.

With respect to bingo, in this popular indoor sport most avid contemporary participants will play more than one card in each game. Some of them, in fact play so many cards as to approach the limits of their concentration. While this practice is not discouraged by the promoters of the game, heretofore there have few devices available enabling the multicard player to keep all of his cards in front of him, and what few devices there are have proven relatively inefficient. Typically such a player spreads all of his cards out in front of him, each lying flat on a horizontal table top with the array spread fore and aft to his left and right. This takes up a good bit of space, where otherwise two or three players might be accommodated. Great concentration and some measure of physical agility, including keen eyesight, are then required if the one person plays, for instance, as many as 20 cards. There has been an obvious need for some sort of rack or other device to permit playing a large number of cards without such disadvantages.

The only such prior art device known to the present inventor is a card holder in the form of a pair of toothed rails or racks (linear gears) extending away from the player. The upper extremities of the teeth lie in a common horizontal plane, and the depths of the sockets lie in another horizontal plane. The bingo cards are inserted so that their lower edges enter the sockets of both racks, and these sockets are contoured so that the cards can be flipped between an extreme back position and an extreme forward position, each about 45 degrees away from a vertical orientation. Such holder has not proven feasible, as it requires the user to sit in a stretched-neck position, so that he can look over the top of the forward-leaning cards to see the next card in the rear, still leaning backward. It is also awkward to reach behind the cards tilted forwardly to move the shutters of the next card. And, obviously, only the fronts of the cards are useful; the player can not read any card inserted backwards.

A card holder box somewhat similar to that just described is disclosed by David R. Miller in U.S. Pat. No. 4,241,921. Miller's transverse grooves, however, are not carefully contoured to receive only a single card in each groove, nor do the grooves control the extreme positions of the cards; he teaches that the grooves simply prevent the bottom of the cards from slipping. Miller found it necessary to include a pair of tilted supports in his holder, one leaning forward and the other leaning backward. Since all of the cards rest on the grooved horizontal bottom of his box, Miller's device has the same disadvantages of the rack device described above, plus an additional disadvantage. Since the Miller box does not keep any spacing between adjacent cards, the back of each card touches the front of the card behind it. When a card is flipped from one position to another so that they brush together, the shutters on one card may be inadvertently moved, giving the player a false reading on numbers that have been played, delaying the game and casting suspicion on the player.

A "filing device" that might be thought adaptable for playing bingo is disclosed by Chatham in an earlier U.S. Pat. No. 1,119,925. Chatham discloses a shallow drawer in which a group of thin L-shaped plates are hinged on a like number of pins extending through the upright sides of the drawer, with filed papers placed between adjacent plates. Each plate has both a nearly vertical position and a nearly horizontal position. In the nearly vertical position the plate leans slightly to the rear of the box and is supported in such position because the joint of its two legs rests on the bottom of the box, one of such legs being much shorter than the other and extending from such contact to the hinge pin, and being perpendicular to the main leg which extends upward from the box with the described nearly vertical tilt.

The principal disadvantage of the Chatham device lies in the nearly horizontal positions of the hinged plates, because in such positions the player cannot make any use of the back surfaces of the plates. If it were to occur to him to clip a bingo card to such a back surface and then to read and play this card, after playing the front card and flipping the plate to its forward position, he would discover that such position is too far from horizontal. The plate nearest him would depart only slightly from horizontal (but in the harder-to-read direction, the plate's surface sloping down and away from him), but the departure would increase on the second plate, grow worse on the third, etc.

This result follows in part because bingo cards have an appreciable thickness, but mostly results from Chatham's construction. Like the other holders described above, in Chatham the hinge pins all lie in a common horizontal plane. When identical flat members of appreciable thickness are pivotally mounted on such an array of hinge pins, they can not be rotated to horizontal positions because of space interference. In going from front to rear, the tilt becomes additive, and it becomes difficult or impossible to read anything on the back of the rearward plates, unless the reader stands up and moves his body to a strained position.

THE PRESENT INVENTION

The present invention avoids such disadvantages of the prior art by providing a number of parallel hinge pins which are spaced from each other both vertically and horizontally. The pin closest to the player is spaced above the table top a distance about equal to the maximum thickness of the rotatable subassembly consisting of a pair of bingo cards mounted back to back and top to bottom (the back card being inserted upside down when the subassembly is nearly vertical, so that it will read properly when swung to the horizontal position) and a pair of clips rotatably mounted on the rod to receive and retain the pair of cards along their opposed marginal edges. With such spacing, when the nearest subassembly is rotated from vertical to horizontal the bingo cards come to rest in a true horizontal position, or perhaps with a slight tilt making the rear card more easily read, i.e., sloping downwardly from the pin to the player.

This same vertical spacing is maintained between the first and second hinge pins, so that when the second subassembly is rotated from vertical to horizontal it too will come to rest so that the bingo card surfaces are truly horizontal (or with a slight slope down to the observer). It may even be thought desirable to increase the vertical spacing somewhat, so that the second set of cards slopes down to the player at a steeper angle, and similarly for the third and successive subassemblies. It is not desirable to carry this increasing slope concept to an extreme, however, as the overall height of the rack loaded with cards would approach the impractical limit of the sum of the heights of the cards. Since the cards do have an appreciable height, with such limit the player would have to stand to see over his rack, or the number of cards would have to be considerably reduced.

The present inventor also found it necessary to conceive a special clip or retainer to receive and hold bingo cards, and now discloses the same not only as an important feature of his bingo cards rack but also as a device useful for retaining and displaying many other types of documents, e.g., maps, photographs, well logs, hospital charts and the like, with or without other parts of the bingo cards rack. The clip is made to be used in pairs, each being shaped overall somewhat like a stubby rod or finger. One end is solid except that is has a transverse opening so that it can be mounted on the hinge pin. Above such end or bottom there is an elongated pocket closed on only four sides, the top being open for inserting and removing the card and one side being open so that only the marginal portion of the bingo card is received in the pocket. Above this pocket are a pair of opposed spring fingers which bow towards one another and nearly touch, being separated a distance less than the thickness of the card or cards to be inserted. The fingers must be pushed apart by the entering cards, and their reactive forces serve to grip and releasably retain the cards in the pocket.

A pair of these clips mounted on a rod so that the open sides of their pockets face one another may be slid along the rod to obtain the proper spacing, and the bingo cards pushed into their pockets so that the left and right margins of the cards are held tightly, but without obscuring any of the numbers, shutter levers, or other parts of the card used in the game. Since bingo cards are customarily fairly stiff, they may be relied upon to unite the two clips so that cards and clips rotate as a unit.

However, it will be apparent to the reader that a certain amount of time and manual dexterity are required to slide the cards into the otherwise unjoined clips. To save this time and simplify the insertion step, the preferred construction is one wherein the pair of clips are more or less permanently secured together by other structural elements, but nevertheless permitting the clips to be slid along the rod to change the spacing between them. This is desireable because bingo cards come in different widths, and a player who carries his rack from one place to another may need to adjust his spacing accordingly.

The present inventor prefers to join his clips together by a thin strip of rigid material such as sheet matal or a hard plastic, but without any permanent joining. He accomlishes this by providing a thin slit in the end portion of the clip, this being the portion whose inner surface provides the largest surface of the pocket, and which is opposed to the open side of such pocket. The slit is preferably closed at both top and bottom, so that the clip and thin strip can be assembled only by relative lateral movement, parallel to the hinge pin. By making this slit a through opening, all the way through the end portion of the clip, the assembly may include the features of projecting the strip a short distance outside the end portion of the clip. With snug fits between these two members, it has been found that there is little or no tendency to accidental disassembly, despite the lack of glue, welding, or other permanent connections.

There are two additional advantages obtained with such connecting strip subassemblies. One of these lies in the fact that the clips are preferably made with bilateral symmetry, each being symmetric in a plane passing through the center line of the hinge pin on which the clips are mounted. This plane of symmetry also bisects the narrow slits along their long lengths, and thus bisects the connecting strip between such slits. The result is that such structure divides each clip pocket into two halves, a front half pocket and a rear half-pocket. When the player decides to change only one of the cards previously played, he can then do so without having to remove the adjacent card. He may also use only one half-pocket to hold a bingo card, leaving the other one empty.

Perhaps more significant is the fact that each rod disposed in the rack may be made long enough to accomodate 2, 3, or more subassemblies, each of which include a pair of bingo cards inserted back to back. The connecting strips may be similarly extended to include 2, 3, or all such subassemblies, as there are no partitions between adjacent subassemblies. In the preferred construction all card pairs mounted on any one rod are thus joined as one subassembly. This gives the player a time savings when he scans all of his cards, as it reduces or eliminates much of the flipping. The player starts with all cards vertical, scans the front faces of the first assembly, flips it once to horizontal and scans the backs left to right, looks up to scan the vertical front faces of the second assembly, flips it once to examine the backs, etc. Such time saving is important to the avid player, as he utilizes it to play more cards in the time between calls by the barker (caller) who is conducting the game.

Although there are references above to the cards having a "vertical position," this is only a shorthand way of saying that such position is nearly vertical but slightly tilted up and back from the mounting rod (hinge pin). This tilt gives the subassembly greater stability and makes the cards easier to read. Such tilt is built into the rack by a flange projecting from the end frames of the rack, as will be seen in the discussion of the drawing figures below.

The rack ends are simply two independent frame members, preferably joined only by the group of rods which serve as hinge pins for the card-receiving subassemblies. They are most simply made as two triangular blocks, each having a flat base to rest on a table top, a vertical back, and a slanting surface which is approximately parallel to the rods and to the row of openings which receive the rods. Such openings preferably extend through the thickness of the end frame to promote interchangeability and rapid assembly and disassembly, the latter because some players prefer to use their own racks and to carry it with them from one establishment to another.

These end frames support and define the raised position of only the uppermost subassembly. It is not necessary to provide similar stops or supports for the other subassemblies, as the uppermost one supports the one adjacent to it, which in turn supports the next and so on down to the lowermost subassembly. Nevertheless, the structure described has the advantage of a complete lack of contact between a card in one subassembly and the adjacent card of the next subassembly. This results from the fact that the clips which receive the cards extend out beyond the cards, both to the front and to the rear. When the uppermost subassembly supports the next subassembly in raised position, it is by virtue of contact between the clips, which space the cards from one another and keep them out of contact. This is important to the player, for it prevents anything from contacting the shutters until the player moves them manually. Thus there are no false indications that a particular number has been called.

DETAILED DESCRIPTION OF THE PRESENT INVENTION

The present invention may perhaps be better understood by referring to the accompanying drawing, and studying the same in connection with the following description thereof.

In the drawing:

FIG. 3 is a perspective view of one of the clips which are mounted on the rods of the rack to receive and hold bingo cards in place—and may be similarly used to retain other documents.

FIG. 4 is a perspective view of a shutter of a bingo card as removed therefrom, together with its integral lever.

Figure 1:
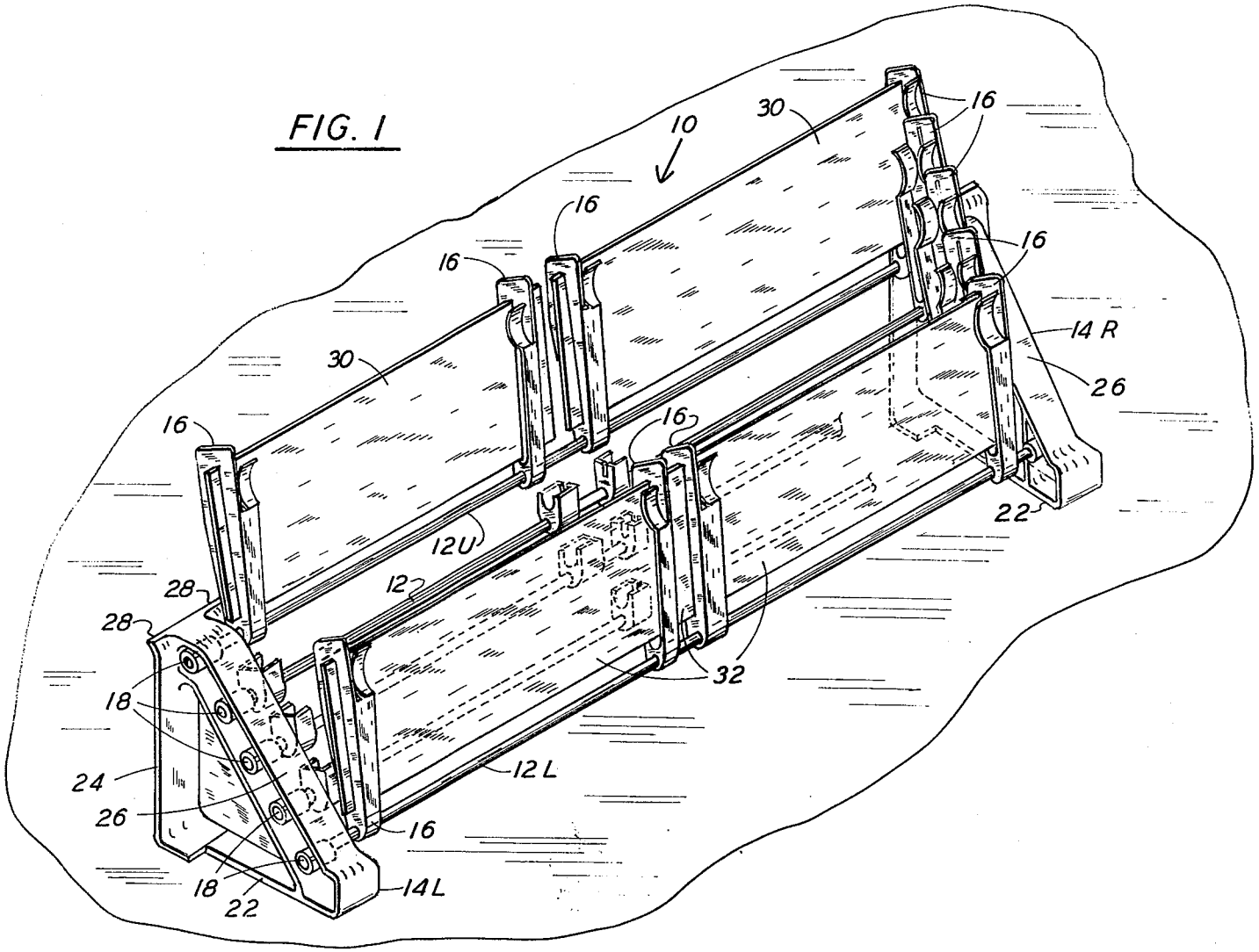
FIG. 1 is a perspective view of a bingo card rack according to the present invention, this view being made without any bingo cards in the rack but showing more than one arrangement of clips and connecting strips.

The rack 10 shown in FIG. 1 includes five (5) horizontal rods or hinge pins 12 extending between the left hand end frame 14L and the right hand end frame 14R. The pins 12 are indistinguishable from one another prior to assembly, and becomes distinguishable thereafter only by position, hence for talking purposes letters are added only for convenience, 12U designating the uppermost pin and 12L the lowermost. This is also true of true of the ends 14L and 14R. It is of considerable advantage to the fabricator to minimize the number of different parts he must obtain and put into an assembly, having only one rod 12, one end frame 14 and one clip 16.

At each of its ends, each rod 12 (12U, 12L) is received within an opening 18 provided for it in the end frames 14L and 14R. As ilustrated, the rod terminates within the length of opening 18, and the fit may be a light force fit or a threaded connection. It is also feasible to let the rod project out of the opening and provide a quickly disconnected termination, such as cap nut, if desired.

Each end frame 14L and 14R is generally triangular, as shown having a horizontal base 22, a vertical leg 24 and a slant leg 26. While such end frames may be made of any triangular block of rigid material, the preferred form for mass production is the molded plastic end frame shown in the drawing figure. It is important that the vertical leg 24 is wider than the other legs 22 and 26, extending laterally with flanges 28 which support the clip 16 mounted on rod 12U and disposed adjacent to end 14L, as shown in the figure. With corresponding support of the clip 16 disposed on rod 12U adjacent to end frame 14R, all of the subassemblies of the rack, as loaded with bingo cards, are supported in the vertical position illustrated. This is true irrespective of how the subassemblies are joined, i.e., whether a single long connecting strip 32 is used to connect adjacent subassemblies, as in those mounted on the lowermost rod 12L, or shorter strips 30 are used to connect only the pairs of clips 16 for a single pair of cards, as in the subassemblies mounted on the uppermost rod 12U—or even when no strip at all is used, as suggested for the intermediate rows shown in FIG. 1.

Each clip 1 as shown in FIG. 3 consists of three basic parts: a base portion 40 which contains the bore or through opening 42, the pocket-defining members which include end plate 44 and the pair of opposed sidewalls 46, and the pair of opposed spring fingers 48 joined only to the free ends of sidewalls 46 and being more or less continuations of such sidewalls. The sidewalls 46 are rigidly connected to end plate 44, and one or both end plate and the pair of sidewalls, preferably both, are rigidly connected to the base portion. It should also be noted that the pocket includes as its bottom wall a portion 41 of the outer surface of base 40. All of these parts, in fact the entire clip 16 is preferably made of a hard plastic in a single molding, thus eliminating any joining, cutting and drilling operations.

The end plate 44 is preferably formed with the long, narrow slot 45 midway between its connections to sidewalls 46 and lying on an imaginary plane passing through the center line of borehole 42. Slot 45 extends completely through the thickness of end plate 44, but preferably does not extend through the top of the plate, as shown in the figure. It is approximately only 1/16th inch wide, and it serves to receive one of the connecting strips 30 or 32 in snug but slidable relationship. When such a strip is passed through aligned slots 45 of two clips 16 mounted on the same rod with the same azimuthal orientation, it divides the pocket 50 formed by portions 41, 44 and the two sidewalls 46 into two half-pockets of equal size, each of which then has a surface of the strip replacing one of the sidewalls as a boundary.

The spring fingers 48 are arcuate as shown, and are disposed to bow toward each other. It is important to note that each is joined to the other portions of clip 16 only along its lower edge, where it joins the upper edge of sidewall 46; there is actually a gap between finger 48 and end plate 44. Th two spring fingers are dimensioned and disposed so that the gap between their bowed portions at nearest approach is less than the thickness of two bingo cards, even when no strip 30 or 32 is used. As the pair of back-to-back cards are pushed down so that one of their marginal portions lie directly above the pocket 50 they first force the two spring fingers 48 further apart, and then enter the pocket. Since a good percentage of the card height extends above the pocket, the fingers are held in this expanded position, and their reactive force aids in releasably retaining the cards in the pocket of the clip. Such retention is also aided somewhat by the inwardly and downwardly tapering disposition of the sidewalls 46, together with the small spacing between them where they join the bottom portion 40 at surface 41. This spacing is preferably designed to receive the thicknesses of two bingo cards made of the usual laminated paper. The cards are fully seated on surface 41, but only with a slight compression of the paper material.

As an example, the inventor has made clips 16 to accomodate laminated paper bingo cards of $8\frac{1}{4}$-inch height, $7\frac{1}{2}$ inch width and 3/16ths inch thickness. All material of the clip was a hard plastic, e.g., "Delrin", an acetal holopolymer, extruded in one operation. Overall dimensions were about 4 inches height, depth of 0.875 inch (maximum width of end plate 44), and a width of 0.563 inch, which of course is the axial length of borehole opening 42 and the parallel dimension of sidewalls 46. Bas portion 40 was rounded with a diameter of about 5/16ths inch, and center hole 42 there through had a diameter of 0.188 inch (to receive a rod or pivot pin 12 of 3/16ths-inch diameter). Using a horizontal through the center of 42 as a reference, sidewalls 46 extended vertically to joint 47 a distance of 2.281 inches, at a 7-degree taper, and each was 0.063 inch thick. Each spring finger 48 was of comparable thickness and curved inwardly with a radius of 0.688 inch, with a vertical dimension of about 1.126 inch.

The gap between spring fingers 48 and end plate 44 was 0.125 inch, and the thickness of end plate 48 was 0.063 inch. It had a width of 0.875 above joints 47, and below those joints tapered the same as sidewalls 46. Slot 45 was 0.065 inch wide by 3.031 inches long, and had an upper termination about 7/16 inch below the upper edge of end plate 44; it snugly received connecting strip 30 or 32 having a thickness of 1/16th inch and a height of 3.0 inches.

Of course, the pocket 50 in the clip has an open top, between spring fingers 46, and is open on the side facing and opposed to end plate 44. This permits insertion of the bingo cards from the open top, between spring fingers 48, and permits all of the card except the marginal portion to extend laterally out of the pocket, where all of the indicia and shutter controls are in full view.

In an overall assembly, all rods 12 were of 17.0 inches length and 3/16ths inch diameter. While various materials may be used, a stainless steel or chrome plated metal is preferable, to avoid corrosion and consequent roughness. When assembled to the ends 14L and 14R, the length of rod 12 between ends available for mounting the rotatable card assemblies was 16.0 inches. When assembled with the aforementioned bingo cards of 7½ inch width, each subassembly consisting only of two back-to-back cards and two clips 16 measured 15¼ inches in overall length, from the outwardly facing surface of one end plate 44 to the corresponding surface of the other. When two such subassemblies were joined together by a long connecting strip 32 which protruded 3/16ths inch from each of the clips 16 (actually from end plates 44) located at the lateral extremities of the joined subassemblies, there was still a slight clearance between each end of the strip and the adjacent end frame 14L or 14R.

In each such end frame, the openings 18 for rods or pivot pins 12 (12L and 12U) were spaced vertically from one another 0.868 inch, and horizontally 1.072 inch, making the angle of the slant leg 26 with table top T approximately 39 degrees. Lowermost opening 18 was spaced 0.644 inch above the table top T, and uppermost opening 18 was spaced 0.313 inch from vertical leg 24 of the end frame. Each flange 28 of such vertical extended about 3/16th-inch into the clear distance along rod 12U available for mounting the rotatable subassemblies, an adequate amount to support the subassemblies leaning against it. Although each vertical leg 24 has flanges 28 extending in both directions, obviously only the one extending toward the opposed end frame is utilized; they are made as illustrated simply to make them interchangeable.

FIG. 1 also shows that the rack as made for bingo cards of any particular size may also be used for cards of a smaller size. Thus the bingo cards to be mounted on uppermost rod 12U may be of smaller width and height than those to be mounted on the other rods 12. To accommodate them the two centrally located clips 16 have been moved away from each other, each being moved closer to an end clip 16 to receive a card of reduced width. Each of the two pairs of clips 16 is joined by a short connecting strip 30.

Figure 2:
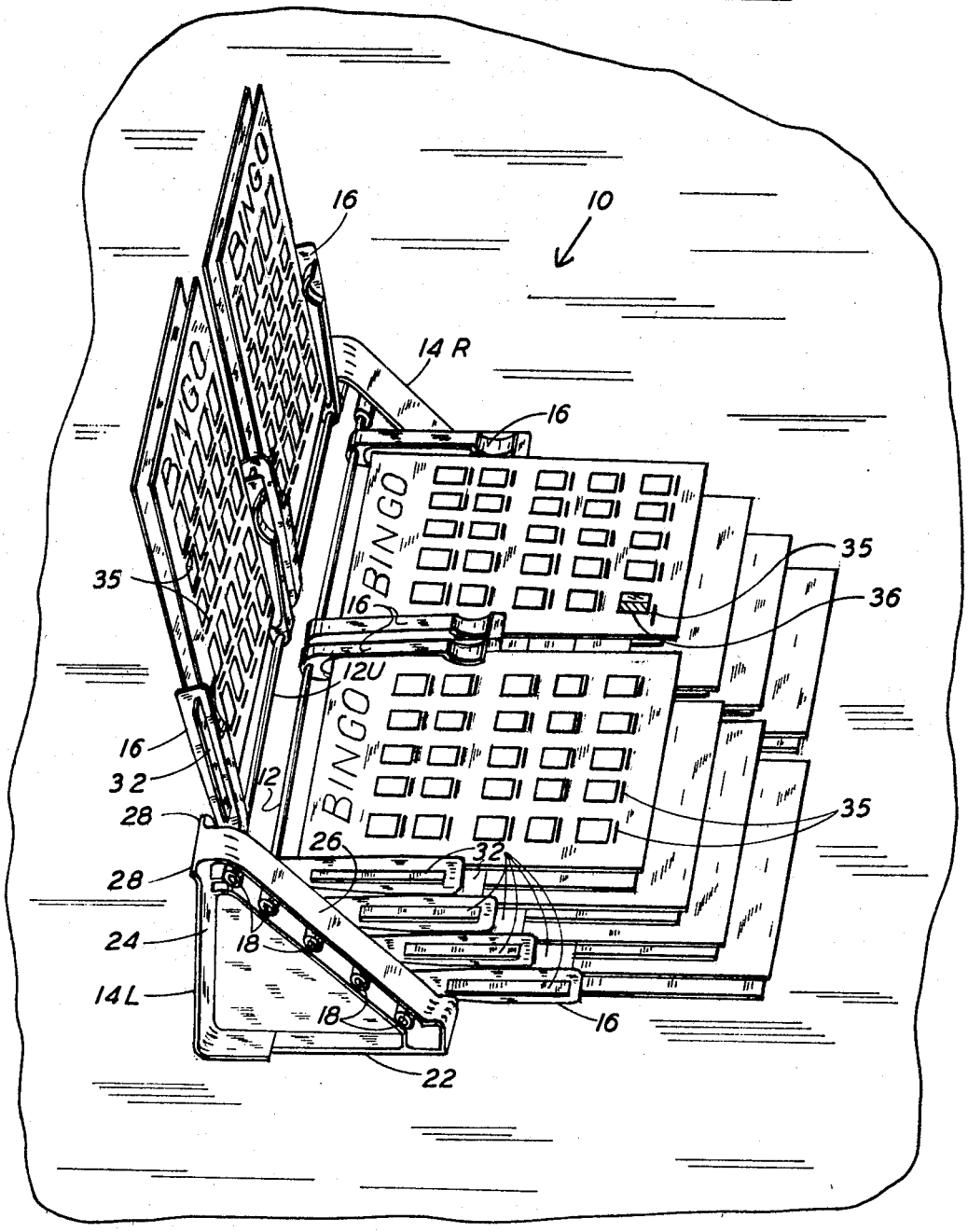
FIG. 2 is a perspective view of the same rack from another vantage point, this view showing the rack with bingo cards inserted.

FIG. 2 illustrates the same rack 10 as in FIG. 1, but now loaded with bingo cards. Both of the pairs of subassemblies in each row have been joined together by a long connecting strip 32, so that the player rotates 4 cards together. He has swung all but the uppermost double pair to the horizontal position, and is in the process of checking the horizontal cards of the 4th row and the vertical cards of the uppermost row.

FIG. 2 also illustrates the shutter lever or slider 35 by which the player keeps track of the numbers on his cards which have been called by the promoter in the course of a game. On the horizontal card shown in the fourth row left, all of the shutters are to the left, signifying that none of the player's numbers on that card have been called. On the right hand card, however, the shutter for Column B, bottom row is being closed, signifying that "B-11" has been called.

The shutter is typically a small sheet of tinted plastic, one that is transparent enough to permit the player to read the underlying number but tinted enough to be clearly different from an uncovered numeral. As indicated in FIG. 4, the shutter 36 is integrally attached to the lever 35, at right angles. Each such shutter operates within its own individual pocket underlying the top layer of the bingo card.

It is submitted that the foregoing description illustrates the advantages of the bingo cards rack claimed below, one that it is capable of holding a large number of cards in such manner that the space preempted by the loaded rack is minimized, and the number of cards to be played is maximized. In particular the number of cards held in the rack is doubled by mounting them in pairs, the two members of each pair being mounted back-to-back in the same pair of end clips which grip the two cards along their opposed marginal edges, the end clips being pivotally mounted on horizontal hinge pins to have two reading positions, a nearly vertical position for reading the forward card and a nerly horizontal position for reading the rearward card.

An important feature to increase the capacity of the rack by way of accommodating card-and-clip subassemblies disposed one behind the other is the manner of mounting the horizontal hinge pins of the different subassemblies in relationship to one another. The inventor disposes these hinge pins in staircase fashion, spacing them vertically as well as horizontally, so that as each subassembly is swung to its lower position it assumes an approximately horizontal position, enabling the player to read each rearward card with ease.

It will be apparent that the clips can receive and releasably retain other appropriate objects such as photographs, well logs, etc., by merely adjusting dimensions. Use for such purposes is within the scope and spirit of the present invention. The invention should be limited only by the appended claims, which should be construed to embrace all substantially similar structures disposed in substantially similar postures to accomplish substantially similar purposes.

What is claimed is:

1. A rack for holding bingo cards and similar objects of generally rectangular shape, said rack including a multiplicity of horizontal pivot pins disposed and supported parallel to one another in ascending staircase relationship, and a subassembly pivotally mounted on each pivot pin and having two stable positions at the extremes of its rotary motion, an approximately vertical position and an approximately horizontal position, each said subassembly comprising a pair of clips received on said pivot pin through a transverse opening in one end of the clip, pocket-defining end and side members to receive and hold a marginal portion of a pair of back-to-back bingo cards or similar objects, and a pair of spring members to releasably restrain said cards in the pocket, said pair of clips being spaced apart along said pivot pin to receive a pair of opposed such marginal portions.

2. The rack of claim 1 which further includes a thin connecting strip extending between and supported by said pair of clips, said connecting strip being disposed to divide said pocket into two half pockets.

3. The rack of claim 2 in which said connecting strip extends through narrow slits in said pair of clips.

4. The rack of claim 3 in which there are a multiplicity of said pivotally mounted subassemblies mounted on one of said pivot pins and said connecting strips extends through all such subassemblies, whereby all of them are rotatable together between said extreme positions.

5. A clip capable of receiving a marginal portion of a number of cards of common dimensions and releasably holding such cards, comprising a bottom, an end and two sidewall portions disposed and rigidly secured together to define a pocket having as its boundaries four surfaces of such portions but having an open top and one open end, said end portion and sidewall portions being elongated and extending from the bottom portion in the same general direction with the sidewall portions normal to the end portions, the two sidewall portions being generally parallel to each other and spaced apart a distance of the order of the thickness of the cards to be received and both extending from the end wall to the open end of the pocket a distance sufficient to accommodate a marginal portion of such cards, and a pair of spring fingers secured to the ends of the sidewalls opposed to said bottom portion but otherwise unrestrained and extending away from the bottom as a general continuation of said sidewalls, said spring fingers being bowed inwardly toward one another so that at their closest approach they are separated by less than the thickness of the cards to be received.

6. The spring clip of claim 5 which is bilaterally symmetric in an imaginary plane normal to and bisecting said end portion, said plane passing midway between and generally parallel to the two sidewalls and spring fingers, and in which said end portion has an elongated slot through its thickness at the trace of said plane of symmetry on the end portion, said slot having a thickness to accoommodate a thin plate centered on said plane of symmetry.

7. The spring clip of claim 5 wherein said bottom portion has a pivot pin receiving hole therethrough along a line parallel to a normal to said end portion, whereby a pair of said clips may be mounted on a common pivot pin with the open sides on the two clips facing one another and spaced apart to receive a pair of opposed and parallel marginal portions of said number of cards to releasably retain the same.

8. A rack for holding bingo cards and similar objects comprising a multiplicity of parallel and horizontal pivot pins disposed and supported in ascending staircase fashion, and means pivotally mounted on each pivot pin one behind the other to releasably receive and restrain a pair of back-to-back bingo cards or similar objects along a pair of opposed and parallel marginal portions thereof, said means having an extreme upper position in which it is nearly vertical and an extreme lower position in which it is nearly horizontal.

9. A bingo card rack permitting a single player to mount and play a multiplicity of cards comprising (a) a pair of end walls spaced horizontally from one another, (b) a multiplicity of horizontal rods secured in both said end walls and extending therebetween, said rods being parallel to one another and disposed in ascending steps from the front of the holder to the rear thereof, (c) a number of card-receiving assemblies pivotally mounted in said rack on said rods, each said assembly including a connecting strip or plate extending from left to right at least the width of a bingo card and having at both its left end and its right end a pair of resilient fingers to releasably secure a pair of bingo cards to the two surfaces of the plate, each said assembly having one extreme position in which the bingo card held on the front of the assembly faces the player and is substantially vertical and a second extreme position in which the front surface of the bingo card held on the rear surface of the assembly is face up and substantially horizontal.

10. A bingo cards holder comprising a pair of horizontally spaced end members, a multiplicity of pivot rods supported by such end members and extending horizontally therebetween, said pivot rods being parallel to one another and disposed stepwise so that in proceeding away from the user the second rod is both behind and above the first rod, the third is behind and higher than the second, etc. and at least one pair of card-receiving clips pivotally mounted on each rod in horizontally spaced relationship to each other, each said clip being elongated in the direction normal to the rod and having at one end a through opening to receive said rod, thhe opposed end and one side being open to define a pocket capable of receiving the marginal portion of a pair of bingo cards placed to back, said clip also including a pair of oppositely acting spring fingers which are spread apart as the pair of cards are pushed into the pocket.

11. The bingo cards holder of claim 10 which further includes a thin strip extending between and joining the pair of card receiving clips between said pair of spring fingers, whereby rotation of either of the clips will also cause rotation of the other clip and the thin strip.

12. In a rack containing an array of rotatable flat members stacked in an approximately vertical position and aligned one behind the other from front to back, the front surface of each said flat member presenting indicia facing an observer in front of the array, said flat members being individually mounted on horizontal and parallel pivot pins for rotation toward the observer so that such observer may scan the indicia on the first member, rotate it towards himself, scan the indicia on the second member and rotate it towards himself, and so on to the most rearward flat member, the improvement comprising disposing said pivot pins in staircase fashion so that the pivot pin nearest the observer is lowermost, the second pin is spaced above and to the rear of the first, and so on to the most rearwardly pivot pin.

13. The improved rack of claim 12 which is further improved so that indicia on the back surfaces of said flat members is readily scanned by said observer after each flat member is rotated forward as far as possible, said further improvement comprising a spacing between each pair of adjacent pivot pins at least equal to the maximum thickness of the flat member and its rotatable supporting structure.

* * * * *